United States Patent [19]

Dews

[11] 4,205,750

[45] Jun. 3, 1980

[54] DOUBLE-SEAL CONTAINER AND METHOD

[75] Inventor: James K. Dews, Mineral Wells, Tex.

[73] Assignee: The Dews Co., Inc., Mineral Wells, Tex.

[21] Appl. No.: 959,069

[22] Filed: Nov. 9, 1978

[51] Int. Cl.[2] ..... B65D 65/04; B65D 81/00; B65D 83/04; B65D 85/56

[52] U.S. Cl. ..... 206/534; 53/442; 53/449; 53/474; 53/479; 206/497; 206/521; 206/540; 229/DIG. 12

[58] Field of Search ..... 220/449, 461; 426/127; 53/442, 447, 449, 472, 479, 415; 206/45.33, 498, 459, 534, 497, 521, 540; 229/DIG. 12

[56] References Cited

U.S. PATENT DOCUMENTS

| | | | |
|---|---|---|---|
| 2,222,042 | 11/1940 | Nitardy et al. | 215/231 |
| 2,275,293 | 3/1942 | Foley | 206/540 |
| 2,469,366 | 5/1949 | Burbank | 53/415 |
| 2,700,518 | 1/1955 | Ryno et al. | 206/583 X |
| 3,190,441 | 6/1965 | Rausins | 53/449 X |
| 3,307,319 | 3/1967 | Christensen et al. | 53/449 X |
| 3,481,455 | 12/1969 | Graham et al. | 206/584 X |
| 3,667,598 | 6/1972 | Zelnick et al. | 53/442 X |
| 3,669,255 | 6/1972 | Raymus | 53/442 X |
| 3,681,092 | 8/1972 | Titchenal | 206/497 X |
| 4,101,292 | 7/1978 | Hogan | 206/497 X |

*Primary Examiner*—Allan N. Shoap
*Attorney, Agent, or Firm*—Wofford, Fails & Zobal

[57] ABSTRACT

A container for holding articles and a method for forming this container. The container comprises a support structure having a first bag disposed inside of the support structure and a second bag sealed closely about the outside of the support structure. The first bag is sealed about the articles and bonded to the second bag to hold the container in one piece after the bags have been opened to reach the articles. The method comprises the steps of sealing the first bag about the articles and placing it in the support structure; sealing the second bag about the support structure; shrinking, by heating, the second bag until it forms a closely fitting sealed surface about the support structure; and forming a bond between the first and second bags to hold the container in one piece after it is opened.

14 Claims, 3 Drawing Figures

DOUBLE-SEAL CONTAINER AND METHOD

BACKGROUND OF THE INVENTION

1. Field of the Invention

This invention relates in general to containers for holding articles and to methods of making containers for holding articles.

2. Description of the Prior Art

Prior to this invention containers for articles were available with a wide variety of features. In the area of containers for small perishable articles such as pills and food items, several special features are desired. The first of these is that the container be initially sealed and resealable after opening if all of the articles are not to be used at once. The container should also be easily and attractively displayed on a shelf or the like with a label describing the contents observable by a consumer. The container should provide protection for the contents during transport and use; this protection preventing the articles from being crushed and preventing the seal from being broken. The container should be composed of inexpensive materials and yet be sanitary to prevent contamination of the contained articles. The container should be easily and economically filled with the articles. Finally, the container should be attractive to the consumer and convenient to use. In the past, while containers have been able to embody many of the above desirable features, none have been completely satisfactory. The most commonly used container of the above type is a bottle made of glass or plastic with a screw-on lid which seals the bottle. While having many of the desired features its main disadvantage is that it is expensive. Often the cost of packaging is greater than the cost of the contents of the package. In such a situation it is obvious that a reduction in packaging costs would greatly benefit both the manufacturer and the consumer by significantly reducing the retail cost to the consumer.

In the past the methods of making containers were also relatively expensive and required the use of expensive materials. As mentioned above, these methods were most commonly methods of forming bottles and lids. Others methods, such as heat shrinking plastics about boxes were unsatisfactory since they did not provide a rugged and sterile container. Additionally, heat shrinking methods did not produce containers which were convenient to use.

SUMMARY OF THE INVENTION

It is accordingly an object of the present invention to provide an economical method for forming a container for articles, having the above listed features.

It is also an object of the present invention to provide an economical container which sealingly contains articles and protects those articles for transportation and use.

It is also an object of the present invention to provide an economical container which is easily labeled, is attractive, and is convenient to use and store.

It is also an object of the present invention to provide a completely biodegradable package which can safely hold sanitary articles.

It is also an object of the present invention to provide a method of forming a container for articles which uses inexpensive materials, is simple, and requires relatively small amounts of energy.

In accordance with the present invention, there is provided a container in which a first sealed bag sealingly contains the articles. A support structure is disposed about the first sealed bag. A second sealed bag fits closely about the support structure and in at least one location is bonded to the first sealed bag such that the first sealed bag is held in the support structure after the second sealed bag has been opened.

Also in accordance with the present invention, there is provided a method of forming a container for holding articles wherein the articles are sealed in a first bag. This first bag is placed in a support structure. A second bag is then sealed about the support structure. The second bag is caused to shrink by heating and the shrinking is continued until the second bag forms a closely fitting sealed surface about the support structure. A bond is formed in at least one location between the first bag and the second bag. This bond holds the first bag in the support structure after the second bag has been opened.

There are variations in packing articles in the inner bag, including using cotton or the like as a means of cushioning when needed. These variations include:

(1) Placing articles in the inner bag and sealing.

(2) Placing cotton in the bottom of the inner bag, then placing articles inside and sealing.

(3) Placing cotton in the bottom of the inner bag, putting the articles inside, placing cotton over the top of the articles and sealing.

(4) Placing articles in the inner bag, placing cotton over the top of the articles and sealing.

For a further understanding of the invention and further objects, features and advantages thereof, reference may now be had to the following description taken in conjunction with the accompanying drawings in which:

DESCRIPTION OF PREFERRED EMBODIMENT

Figure 1:
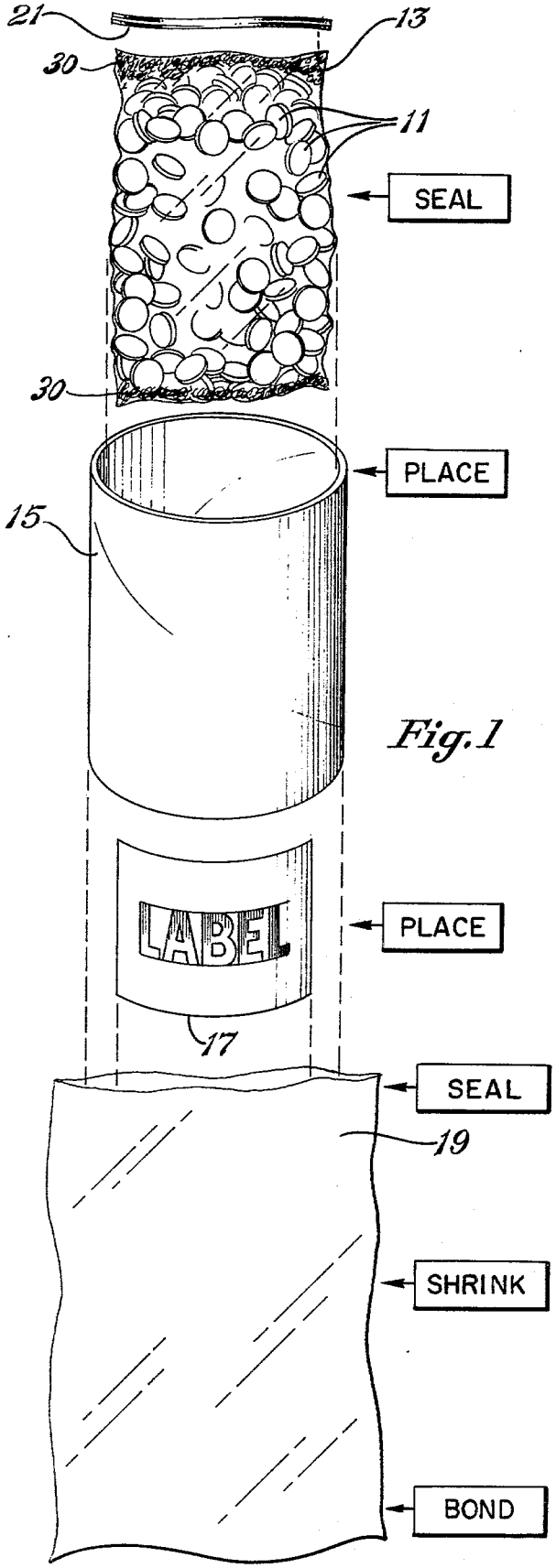
FIG. 1 is an exploded view of the container and a schematic representation of the method of forming the container.

Referring to FIG. 1, the container of the present invention is shown in exploded view. A number of pills or tablets 11 are shown as representative of the articles which this container holds. Surrounding the tablets 11 is a clear plastic bag 13 which is sealed to protect the tablets 11. A rigid tube 15, such as formed of economical cardboard, a paper label 17, a second clear plastic bag 19, and a twist-tie 21 are also shown in FIG. 1. Together these parts form the container of the present invention which has many advantages.

Figure 2:
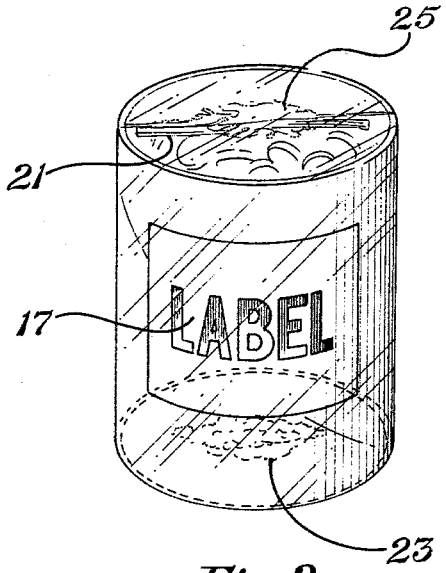
FIG. 2 is a perspective view of the container with the bottom rear portion of the container shown in dotted line.

Referring now to FIG. 2 the container is shown in its assembled form. As can be seen, the container can present an attractive package which is an important feature in retail containers. The plastic bag 13, which is sealed about the tablets 11, is nested inside the cardboard tube 15, away from sight unless the container is viewed from above or below. The second clear plastic bag 19 fits closely about the tube 15, sealing the openings at the top and bottom of the tube 15. Therefore, prior to opening, the package comprises a closed cylindrical shape having two sealed plastic barriers protecting the tablets 11. Further protecting the contents and providing other useful features are two bonds 23 and 25 between the first plastic bag 13 and the second plastic bag 19. Bond 23 at the bottom of the container is especially important since it holds the container in one piece after it has been opened. This retains the contents safely within the cardboard tube 15. Before the container is opened, bond 25, located at the top of the container, works in conjunction with bond 23 to somewhat suspend the first bag 13 inside the cardboard tube 15 which protects the contents during a shock. Of course, bond 25 is broken when the container is opened. Two other features of the container are the label 17 and the twist-tie 21. The label 17 can be glued to the outside of the cardboard tube 15 or merely held in that position by the closely fitting second bag 19. The twist-tie 21 is located inside the tube 15, outside of the first bag 13, ready for use in reclosing the bag 13 by twisting the twist-tie 21 around the later-opened bag 13.

Figure 3:
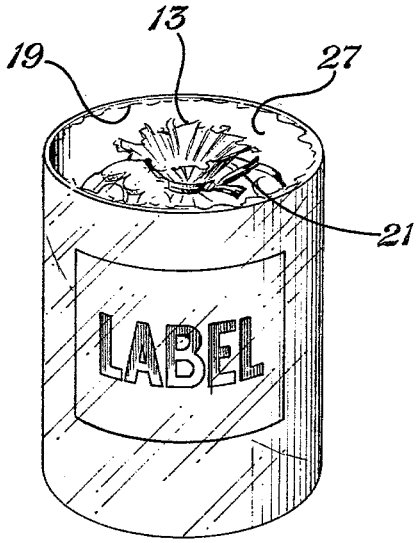
FIG. 3 is a perspective view of the container after opening.

Referring now to FIG. 3, the container is shown after it has been opened and then reclosed with the twist-tie 21. To open the container, the plastic at the top of the container is broken and torn away. The first or inner bag 13 is then opened to gain access to the tablets 11. After the desired number of tablets have been removed then the twist-tie 21, which is loosely positioned inside the tube 15, is twisted around the bag 13 to reclose it. Even after the container is opened, bag 13 remains secure in the tube 15, held by the bond 23 at the bottom of the container. Thus, after opening the container remains an attractive and convenient package which easily rests on a shelf; sealed yet ready for reopening.

The rigid tube 15 may be formed of any available, economical material; such as plastic or a paperboard like cardboard. Ordinarily, materials like glass or metal are infeasible because of lack of economy, lack of availability, difficulty of working or breakage.

A particular advantage of this container is obtained by the use of the cardboard tube 15. By using cardboard for the tube material, strength is provided at a low cost. In the past, however, cardboard was not used where sanitary contents were to be placed in the package since cardboard is not sufficiently free of contaminants. Methods which coated the cardboard proved unsatisfactorily expensive. This container solves this problem in a unique way by using two separate bags in conjunction with the cardboard tube. The inner bag 13 sanitarily holds the contents while the tube 15 provides sturdy protection. This, however, is not enough without the second or outer bag 15. The outer bag 19 provides not only a second seal to protect the contents but also allows the package to form a unitary container. Bond 23 between the first bag 13 and the second bag 19 performs this unitizing function by holding the tube 15 in place between the two bags. Bond 23 remains in place and therefore still holds the container in one piece after the container is open. This prevents the separation of the inner bag 13 from the tube 15 which provides the sturdy protection. The outer bag 19 does not slip away from the tube 15 since it fits so closely about the tube that the tube is held in place. The other bond 25, at the top of the container, further unitizes the inner bag 13 and the tube 15. This aids the protection of the contents by providing a resilient holder inside the rigid protection of the tube 15. However, this bond 25 is broken when the container is opened.

In addition to the economical and utilitarian advantages, the container also provides environmental advantages. The components of the container are readily biodegraded being either plastic or cardboard. Further, since cardboard requires relatively small amounts of energy to make, and there is only a small amount of the petroleum derivative plastic, the container is energy efficient in its parts. Finally, as will be shown, the container requires a relatively small amount of energy to assemble.

The method of forming the container is also new and has many advantages. In this method, the bag 13 is sealed about the tablets 11. Also, the bag 13 is placed in the tube 15. Following these two steps, the second bag 19 is sealed about the tube 15. This second bag 19 is also caused to shrink by heating. This heating is continued until the bag 19 forms a closely fitting sealed surface about the tube 15. A bond is formed at the bottom of the container between the first bag 13 and the second bag 19. Each of the above steps can be performed in various ways, but one preferred method will now be described in more detail.

The bags 13 and 19 are made of any material having the desired properties and economy. These materials include thermoplastics such as polyvinyl chloride, polyethylene, polypropylene, or acrylonitrile butadiene styrene. These types of plastics are impermeable, economical, are easily formed and sealed, provide a sterile environment, and will shrink when heated. With such a plastic the tablets 11 can be sealed in the bag 13 by heat sealing the bag openings. After the bag 13 has been sealed and placed in the tube 15 the second bag 19 can also be heat sealed about the tube 15. Finally, the last two steps of shrinking and forming a bond can be performed in a single heating step which causes the bag 19 to both shrink and bond to bag 13. For example, after or during the sealing of bag 19 a stream of hot air can be directed over the bag 19 which causes shrinking to begin. The hot air stream is continued until the bag shrinks to fit closely about the tube 15. While the bag is shrinking it becomes sufficiently fluid to bond with bag 13 in places where the two bags are in contact. If it is desired to have two bonds, one at the top and one at the bottom, all that is necessary is to orient the bag 13 in tube 15 such that the two bags will touch in those places as the bag 19 shrinks. This orientation can be accomplished in many ways but one method is to size the bag 13 so that it is just slightly longer than tube 15. In this way, as the bag 19 shrinks it contacts both ends of the bag 13 and forms bonds thereto.

Two other features of the method are labeling the package and adding the twist-tie to the package. In order to label the package a paper label can be glued or merely placed on the outside of the tube 15 prior to the sealing of bag 19. After the shrinking of bag 19 the label will be held in place and protected by the closely fitting bag. The twist-tie 21 can be placed inside the tube 15 prior to the sealing of bag 19.

There are several variations in packing articles in the inner bag. For example, cotton 30 or other shock absorbing material may be used as a means of cushioning when needed. The method of packing may include the following:

(1) Place articles in the inner bag and seal.

(2) Place cotton in the bottom of the inner bag, then place articles inside and seal.

(3) Place cotton in the bottom of the inner bag, then put the articles inside. Place cotton over the top of the articles and seal.

(4) Place articles in the inner bag. Place cotton over the top of the articles and seal.

From the above description it can be seen that the method of forming the container is a simple process requiring relatively small amounts of energy. The two sealing steps apply heat only to small areas of the plastic and the amount of heat required for shrinking and bonding is also relatively small. Apparatus to perform the above steps are available in the prior art and therefore not shown in the Figs.

The foregoing disclosure and the showings made in the drawings are merely illustrative of the principles of this invention and are not to be interpreted in a limiting sense.

What is claimed is:

1. A combination, comprising:

a plurality of individual, small articles capable of being separately and individually dispensed, as by pouring, and a container holding said plurality of individual, small articles such that small articles can be individually dispensed, as by pouring, which comprises, said container consisting essentially of:

a. an economical first sealed bag which contains said articles; said sealed bag being adapted to resist contamination of said articles from outside sources and having a first end that is openable and reclosable and having means for effecting reclosure of said first end such that the articles can be used separately as desired from said container over a period of time; said means for effecting reclosure being adapted for sealing reclosure so as to protect said articles from contamination from the ambient atmosphere;

b. a support structure disposed about said first sealed bag; said support structure being rigid so as to prevent crushing of said container about said articles during shipment and the like; and c. a second sealed bag closely fitting about said support structure; said second sealed bag being bonded to said first sealed bag in at least one location remote from the end that is openable for holding said first sealed bag in said support structure after said sealed bag has been opened and during the separate dispensing of said plurality of small articles.

2. The combination of claim 1 wherein said first bag is at substantially atmospheric pressure and unevacuated; said support structure is tubular and has at least two openings: a first opening at one end of its tubular structure which allows access to said articles therethrough when said second sealed bag and said first sealed bag are opened, and a second opening at the opposite end of said tubular structure which has said bond between said first sealed bag and said second sealed bag formed therethrough.

3. The combination of claim 2 wherein said second sealed bag is bonded to said first sealed bag through said first opening for protecting said articles during a shock.

4. The combination of claim 3 wherein said second sealed bag is comprised of a plastic material which can shrink when heated and wherein said support structure comprises a cardboard tube.

5. The combination of claim 4 wherein said first sealed bag is comprised of a plastic which will bond to said second sealed bag upon heating.

6. The combination of claim 2 which further comprises a label for conveying information about said articles; said label being disposed between said second sealed bag and said support structure.

7. A method of forming a container containing small, individually and separately dispensable articles which comprises:

a. placing a plurality of said small, individually dispensable articles in a first bag and sealing said articles in said first bag by closing a first end of said first bag so as to be reopenable such that said articles can be individually dispensed, and providing means to effect reclosure of said first end such that said first bag can be reclosed after articles are separately used therefrom over a period of time, and protect said articles from contamination from ambient atmosphere;

b. placing said first bag in a support structure that is rigid for protecting said small, individually dispensable articles;

c. sealing a second bag about said support structure; said support structure already having said first seal bag contained there within;

d. shrinking said second bag about said support structure until said second bag forms a closely fitting sealed surface about said support structure; and e. forming a bond in at least one location remote from said first end of said first bag that is reopenable and reclosable; said bond being between said first bag and said second bag for holding said first bag in said support structure after said second bag has been opened adjacent said first end of said first bag for dispensing separately and individually the relatively said small articles after said first end is opened.

8. The method of claim 7 wherein said shrinking step and said bond-forming step comprise a single heating step.

9. The method of claim 8 which further comprises the step of placing a label between said support structure and said second bag prior to said heating step.

10. The method of claim 7 which further comprises the step of forming another bond between said first bag and said second bag in a second location oppositely disposed from said first location for protecting said articles during a shock.

11. The method of claim 7 wherein said articles are sealed in said first bag with a shock absorbent material referred to as cotton by a method comprising placing cotton in the bottom of the inner bag, thereafter placing articles inside and sealing said first and inner bag with said articles on top of said absorbent material for cushioning shock.

12. The method of claim 11 wherein said cotton is also placed over the top of the articles before sealing.

13. A container for holding a plurality of small, individually dispensable articles which are to be dispensed separately and individually over a period of time from said container which comprises:

a. a tubular support structure that is large enough to hold a first bag containing a plurality of said articles, said support structure being rigid to prevent crushing of said container about said articles during shipment and the like;

b. a first bag disposed within said said tubular support structure; said first bag being adapted to be opened and closed at one end and being closed at another end so as to sealingly contain said plurality of articles that are to be dispensed separately and individually over a period of time; and c. a second bag sealed closely about said tubular support structure and bonded to said first bag in at least one location remote from said first end so as retain said first bag in said structure during the plurality of dispensing of said individual small articles over a period of time.

14. The container of claim 1 wherein said first bag contains a shock absorbent material referred to as cotton both above and below said articles and said cotton and said articles are disposed within said first bag without having any of said cotton disposed intermediate said articles and the side of first bag, and said first bag is sealed about said cotton and articles.

* * * * *